US006633784B1

(12) United States Patent
Lovelace, II et al.

(10) Patent No.: US 6,633,784 B1
(45) Date of Patent: Oct. 14, 2003

(54) CONFIGURATION OF A REMOTE DATA COLLECTION AND COMMUNICATION SYSTEM

(75) Inventors: John Howard Lovelace, II, Erie, PA (US); Thomas George Cook, Fairview, PA (US); James E. Pander, Erie, PA (US)

(73) Assignee: General Electric Corporation, Schenectady, NY (US)

( * ) Notice: Subject to any disclaimer, the term of this patent is extended or adjusted under 35 U.S.C. 154(b) by 197 days.

(21) Appl. No.: 09/620,003

(22) Filed: Jul. 20, 2000

Related U.S. Application Data

(60) Provisional application No. 60/162,294, filed on Oct. 28, 1999.

(51) Int. Cl.[7] ..... G05B 19/18

(52) U.S. Cl. ..... 700/65; 700/66; 700/22; 700/13; 700/14; 700/12; 700/19; 701/19; 701/24; 701/29; 701/33; 701/102; 701/117; 246/62; 246/72; 246/122 R; 246/167 R

(58) Field of Search ..... 700/22, 65–66, 700/286, 13, 14, 12, 19, 20; 701/33–35, 19, 29, 24, 117, 102; 246/62, 72, 122 R, 167 R, 176, 177, 182 R, 182 B, 182 C, 186, 3–4, 14

(56) References Cited

U.S. PATENT DOCUMENTS

| | | | | |
|---|---|---|---|---|
| 4,517,468 A | | 5/1985 | Kemper et al. | |
| 4,974,181 A | | 11/1990 | Sinderson et al. | |
| 5,513,107 A | | 4/1996 | Gormley | |
| 5,751,339 A | * | 5/1998 | Aramaki et al. | 348/14.13 |
| 5,781,871 A | | 7/1998 | Mezger et al. | |
| 5,786,998 A | * | 7/1998 | Neeson et al. | 701/35 |
| 5,867,714 A | | 2/1999 | Todd et al. | |
| 5,950,966 A | * | 9/1999 | Hungate et al. | 246/62 |
| 5,959,529 A | | 9/1999 | Kail, IV | |
| 6,092,019 A | * | 7/2000 | Aihara | 701/113 |
| 6,107,917 A | * | 8/2000 | Carrender et al. | 340/505 |
| 6,112,152 A | * | 8/2000 | Tuttle | 701/115 |
| 6,135,396 A | * | 10/2000 | Whitfield et al. | 246/182 R |
| 6,175,784 B1 | * | 1/2001 | Jicha et al. | 701/19 |
| 6,246,320 B1 | * | 6/2001 | Monroe | 340/506 |
| 6,263,266 B1 | * | 7/2001 | Hawthorne | 701/19 |
| 6,401,015 B1 | * | 6/2002 | Stewart et al. | 701/19 |

FOREIGN PATENT DOCUMENTS

WO WO 96/27513 A1 9/1996

* cited by examiner

*Primary Examiner*—Ramesh Patel
(74) *Attorney, Agent, or Firm*—Carl A. Rowold; John L. DeAngelis, Jr.; Beusse Brownlee Bowdoin & Wolter, P.A.

(57) ABSTRACT

A method and apparatus for modifying configuration information used to control an on-board monitor located aboard a locomotive. Under the control of a remote monitoring and diagnostic center, the on-board monitor periodically collects information from the locomotive and transmits it to the remote monitoring and diagnostic center. When it is desired to change some aspect associated with the data collection process (including the period during which the data is collected, the types of data collected, etc.), it is necessary to change the configuration file that controls the on-board monitor. The configuration file is changed at the remote monitoring and diagnostic center and then transmitted to the on-board monitor.

7 Claims, 2 Drawing Sheets

CONFIGURATION OF A REMOTE DATA COLLECTION AND COMMUNICATION SYSTEM

This patent application claims the benefit of U.S. Provisional Application No. 60/162,294 filed on Oct. 28, 1999.

BACKGROUND OF THE INVENTION

The present invention is directed in general to monitoring operational parameters and fault-related information of a railroad locomotive, and more specifically, to a method and apparatus for remotely controlling and configuring the monitoring process.

Cost efficient railroad operation requires minimization of locomotive down time, and especially avoidance of line-of-road locomotive failures. Failure of a major locomotive system can cause serious damage, require costly repairs, and introduce significant operational delays. A line-of-road failure is an especially costly event as it requires dispatching a replacement locomotive to pull the train, possibly rendering a track segment unusable until the disabled train is moved. Therefore, the health of the locomotive engine and its constituent sub-assemblies is of significant concern.

One apparatus for minimizing locomotive down time measures performance and fault-related operational parameters of the locomotive during operation. This information can provide timely and important indications of expected and immediate failures. With timely and nearly continuous access to locomotive performance data, it is possible for locomotive repair experts to predict and/or prevent untimely failures.

Such a system is described and claimed in the commonly owned patent application entitled "On-Board Monitor for a Railroad Locomotive". This application bears application No. 09/696,368 now U.S. Pat. No. 6/487,478, and was filed on Oct. 25, 2000. The on-board monitor described therein collects, aggregates, and communicates locomotive performance and fault related data from an operating locomotive to a remote monitoring and diagnostic center. The data is collected periodically or as determined by various triggering events from various locomotive control systems during operation. Generally, anomalous or fault data is brought to the attention of the locomotive operator directly by these control systems, but the locomotive itself lacks the necessary hardware and software elements to diagnose the fault. It is therefore advantageous To utilize an on-board monitor to collect and aggregate the information and at the appropriate time send it to a remote monitoring and diagnostic service center. Upon receipt of the performance data at the remote site, data analysis tools operate on the data to identify the root cause of potential or actual faults. Experts in locomotive operation and maintenance also analyze the received data. Historical data patterns of anomalous data can be important clues to an accurate diagnosis and repair recommendation. The lessons learned from failure modes in a single locomotive can also be applied to similar locomotives so that the necessary preventive maintenance can be performed before a line-of-service break down occurs. If the data analysis process identifies incipient problems, certain performance aspects of the locomotive can be derated to avoid further system degradation and further limit violations of operational thresholds until the locomotive can undergo repair at a repair facility. Personnel at the remote monitoring and diagnostic center also develop repair recommendations for preventative maintenance or to correct faults.

BRIEF SUMMARY OF THE INVENTION

An on-board monitor aboard a locomotive monitors and collects data indicative of the locomotive operation from several locomotive control systems. This data is stored within the on-board monitor and downloaded to a remote monitoring and diagnostic center for analysis and the generation of repair recommendations. The downloads occur on a periodic basis, but certain fault events on the locomotive trigger an immediate download. The on-board monitor operates under control of one or more configuration files stored within it. Among other things, these files include the identity of the operational parameters to be collected and also the events that require an immediate download to the remote monitoring and diagnostic center. The remote monitoring and diagnostic center provides these configuration files and can modify the configuration files as required to change the operational characteristics of the onboard monitor. When the configuration files are changed at the remote monitoring and diagnostic service center, they are uploaded to the on-board monitor whenever a communications link is established between the-on-board monitor and the remote monitoring and diagnostic center.

BRIEF DESCRIPTION OF THE DRAWINGS

The present invention can be more easily understood and the further advantages and uses thereof more readily apparent, when considered in view of the description of the preferred embodiments and the following figures, in which.

DETAILED DESCRIPTION OF THE PREFERRED EMBODIMENTS

Figure 1:
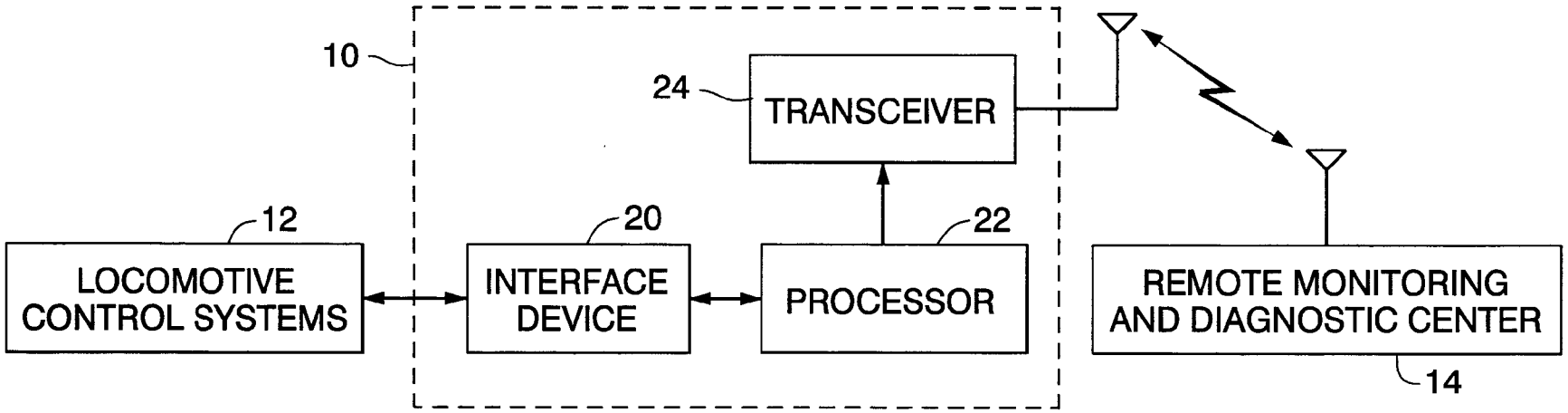
FIG. 1 is a block diagram of the essential elements of an on-board monitor that is configured according to the teachings of the present invention.

Before describing in detail the particular configuration apparatus and method in accordance with the present invention, it should be observed that the present invention resides primarily in a novel combination of processing steps and hardware related to a software configuration technique. Accordingly, these processing steps and hardware components have been represented by conventional processes and elements in the drawings, showing only those specific details that are pertinent to the present invention so as not to obscure the disclosure with structural details that will be readily apparent to those skilled in the art having the benefit of the description herein.

FIG. 1 illustrates the environment to which the present invention applies. A locomotive on board monitor 10 is coupled to a plurality of locomotive control systems, depicted generally by reference character 12. These locomotive control systems can include: a locomotive controller, an excitation controller, auxiliary equipment controller, and a propulsion system controller. The specific nature and function of the controllers are not germane to the present invention, except to the extent that the on-board monitor 10 monitors various parameters associated with these control system. The on-board monitor 10 is described in greater detail in conmonly owned patent application entitled "On board Monitor for a Railroad Locomotive", bearing application No. 09/696,368 now U.S Pat. No. 6,487,487 filed on Oct. 25, 2000. This patent application is incorporated herein by reference.The data collected by the on-board monitor 10 provides important locomotive performance and status information, which is analyzed at a remote monitoring and diagnostic center 14 to identify active faults, predict incipient failures, and provide timely information about existing operating conditions. The data gathering process of the on-board monitor can be modified (either automatically by the system itself or upon command from the remote monitoring and diagnostic center 14) to further isolate or define the nature of the fault. For example, the data gathering process can be modified to collect additional operational parametric information or collect the information more frequently in response to the occurrence of a fault in the system or on command from personal at the remote monitoring and diagnostic center 14, who are attempting to diagnose a particular fault. Also, environment conditions to which the locomotive is subject can serve as the basis for changing the operational data gathering process. For instance, while the locomotive is operating in summer conditions, the data gathering process can be configured to ignore faults and conditions that are relevant only during winter operation, i.e, faults associated with the vehicle cab heating system can be ignored.

The on-board monitor 10 serves the functions of a signal acquisition, signal conditioning, data processing, and logging instrument that provides status information to the remote monitoring and diagnostic center 14 via a bi-directional communication path between the on-board monitor 10 and the remote monitoring and diagnostic center 14. Certain parametric and fault-related information gathered by the on-board monitor 10 is collected and stored as simple data in raw data files. Other data collected is used to generate operational statistics and stored as statistical parameters, rather than stored as raw data. Both the raw data files and the statistical data files are downloaded to the remote monitoring and diagnostic center 14. Likewise, operational commands and reconfiguration commands are uploaded to the on-board monitor 10 from the remote monitoring and diagnostic center 14.

At the remote monitoring and diagnostic service center 14, the data is analyzed by software tools and locomotive repair experts. In response to this analysis, the on-board monitor 10 may require reconfiguration to modify some aspect of its operation. To accomplish this, a reconfiguration signal is sent to the on-board monitor 10 from the remote monitoring and diagnostic center 14. Such a signal might, for example command the on-board monitor 10 to increase or decrease the frequency at which it collects certain parametric information or collect additional parametric data concerning the performance of the locomotive. The data analysis process carried out at the remote monitoring and diagnostic center 14 is discussed in detail in the commonly owned patent application entitled "Diagnosis and Repair system", bearing application Ser. No. 09/644,421, filed on Aug. 23, 2000. This application is herein incorporated by reference.

Certain of the data collection processes carried out by the on-board monitor 10 are based on specific trigger equations. When a trigger equation is satisfied, the onboard monitor 10 engages in the collection of specific information associated with that trigger equation. Thus, each trigger equation has associated with it a list of the parametric operational information to be collected and also a statement of the equation defining when to collect that information. An exemplary trigger equation is: collect cooling water temperature if ambient temperature is less than 30° F. and locomotive is being operated at throttle position eight. The configuration scheme of the present invention allows remote modification of both the triggering statement and the information to be collected when the triggering statement is true.

The on-board monitor 10 comprises an interface device 20, a processor 22, and a transceiver 24. The interface device 20 communicates bi-directionally with the various locomotive control systems 12 and the processor 22. The interface device 20 performs typical signal acquisition and conditioning processes, as is well known to those skilled in the art. The processor 22 controls operation of the on-board monitor 10 including especially the control over the nature and frequency at which data is collected from the locomotive control systems 12. The transceiver 24, under control of the processor 22, communicates with a transmitter/receiver device in the remote monitoring and diagnostic center 14. As is known to those skilled in the art, there are a number of appropriate communication schemes for implementing this link. Included among these schemes are: cellular telephone, satellite phone, or point-to point microwave. Since the locomotive spends considerable time in transit hauling either freight or passengers, sometimes in remote regions, it has been observed that a satellite-based link provides the most reliable communications medium between the locomotive and the remote monitoring and diagnostic center 14.

The on-board monitor 10 includes a call-home feature where a call back to the remote monitoring and diagnostic center 14 is automatically initiated. The call-home feature can be configured from the remote monitoring and diagnostic center 14 such that the call home is made in conjunction with certain anomalous or fault situations that occur either within the on-board monitor 10 or within one or more of the locomotive control systems 12. For instance, when the on-board monitor 10 senses the occurrence of certain predetermined faults in the locomotive, a call-home is made immediately. Note that for all but the most serious faults or those that disable it, the locomotive remains in service during the fault condition. Further, not all faults and anomalies cause an immediate call-home. One such fault involves the operational log of the on-board monitor 10. The on-board monitor 10 maintains the operational log and records the occurrence of various events and anomalies related to the locomotive control systems 12 and the on-board monitor itself. The operational log is downloaded to the remote monitoring and diagnostic center 14 on a periodic basis. In the event the operational log fills the memory space allocated to it, a call-home is made immediately and automatically to the remote monitoring and diagnostic center 14. After the call is set up, the on-board monitor 10 downloads a unique event code indicating that the operational log is full. The call is then terminated and the remote monitoring and diagnostic center 14 calls the on-board monitor 10, instructing downloading of the operational log. If the operational log is not downloaded, old entries in the operational log would be written over as new entries are created, and the information in the operational log would be lost. Finally, the remote monitoring and diagnostic center 14 calls the on-board monitor 10 on a predetermined schedule (in one embodiment three times per day) to download data collected.

To initiate a call-home, the processor 22 commands the transceiver 24 to establish a communications link with the remote monitoring and diagnostic center 14. As discussed above, this link is usually satellite based. When the link is closed, the on-board monitor 10 transmits its unique road number and a code identifying the event that precipitated the call home. One such event code notifies the remote monitoring and diagnostic center 14 that the operational log of the on-board monitor 10 is full. Other event codes relate to the occurrence of certain faults or anomalous conditions on board the locomotive. The call-home then terminates and the remote monitoring and diagnostic center 14 calls the locomotive, using the locomotive road number to set up the appropriate communications link and connect to the on-board monitor 10. In one embodiment, this could be a simple telephone number implemented over a satellite-based link. Once the communications path is established, data related to the specified event number is downloaded from the onboard monitor 10 to the remote monitoring and diagnostic center 14. As discussed above, this information is analyzed at the remote monitoring and diagnostic center 14 for the purpose of creating a recommendation as to certain repairs that should be performed on the locomotive. The remote monitoring and diagnostic center 14 also calls the on-board monitor 10 on a predetermined time schedule to download the raw data files and statistical data files containing information operational parametric information. In one embodiment, three calls to the on-board monitor are made in each day.

The on-board monitor 10 includes a plurality of configurable files that define its operation. The following information is included in these configuration files: the operational parameters to collect from the locomotive control systems 12 (as set forth in the global definition file), the conditions under which certain parameters are to be collected (i.e., data collection triggers), the conditions under which the on-board monitor 10 should contact the remote monitoring and diagnostic center 14 (i.e., call-home faults or anomalies), and certain communication and security information necessary for establishing the communication link. The status of the on-board monitor operations log, discussed above, is included within the third configuration file mentioned above.

The communications and security information file includes the phone number of the remote monitoring and diagnostic center 14, an authorization password, and the user name to be used when the on-board monitor 10 contacts the remote monitoring and diagnostic center 14. Another configuration file is referred to as the remote monitoring and diagnostic center start-up file. This file includes certain timing information for the calls home initiated by the on-board monitor 10. In particular, if the on-board monitor 10 cannot set up the call, information in this file sets forth the number of times it should attempt to call home and the period it should wait between call attempts. The file also provides alternative telephone numbers that can be used to call the remote monitoring and diagnostic center 14. The start-up file contains a list of the software version numbers for the operating software of the various locomotive controllers. The life statistics file contains certain operational information, for instance, the amount of time the locomotive was in notch one, the total time spent in the dynamic braking mode, etc. The custom data file identifies the trigger events and stores the raw data to be returned when one of those triggering events occurs. The signal strength file stores signal strength information, including the locomotive location (as determined by the GPS capabilities of the on-board monitor 10) and the satellite signal strength at that location. Techniques for determining the signal strength of a received signal are well known in the art.

At the remote monitoring and diagnostic center 14, software tools and locomotive repair experts are monitoring the data received from the on-board monitors installed on locomotives operating in the field. Analysis of this information may reveal a change in certain operational parameters or the occurrence of certain anomalous or fault events that suggest the collection of data on a more frequent basis so that a more complete understanding of the nature of the event can be ascertained. Also, changes associated with the operational environment of the locomotive may require the collection of new or different data. For instance, if the locomotive moves into high altitude service (i.e., a lower ambient temperature) for an extended period of time or if the average outside temperature turns colder due to seasonal changes, then more temperature-sensitive operational parameters must be collected or the collection of such data may have to occur more frequently. Once the remote monitoring and diagnostic center 14 is aware of a problem, repetitive calls home due to this known problem are not necessary and therefore the on-board monitor can be reconfigured so that these calls home are avoided. If a determination is made at the remote monitoring and diagnostic center 14 to change some operational or data-collection instruction of the on-board monitor 10, the configuration file related to that change for the specific locomotive is modified. The modified configuration file is stored at the remote monitoring and diagnostic center 14 until the next call between the locomotive and the remote monitoring and diagnostic center, whether that call is due to a scheduled daily download or due to a fault condition.

Figure 2:
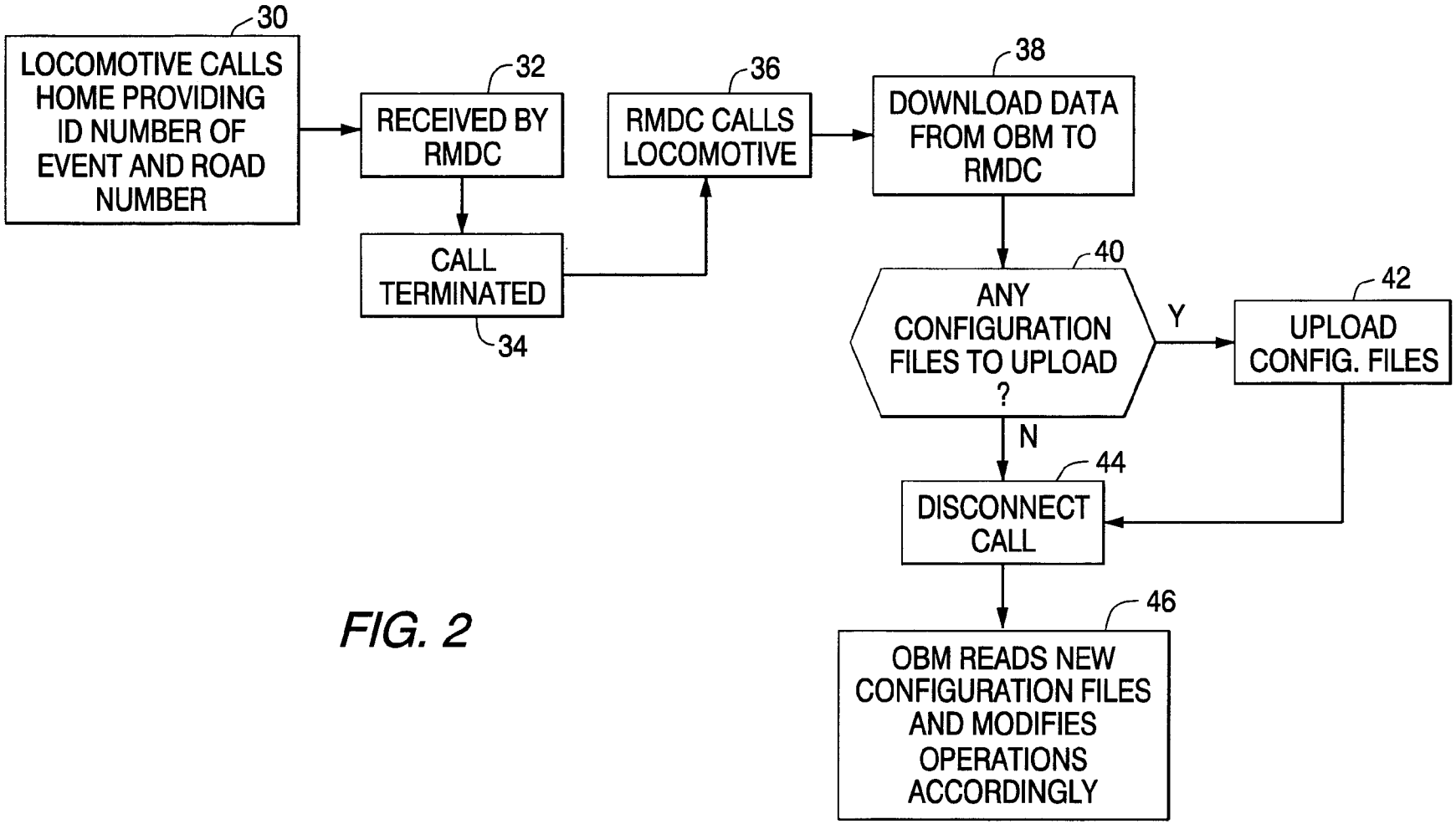
FIG. 2 is a flow chart illustrating operation of the configuration technique associated with the present invention.

FIG. 2 illustrates the process of downloading new configuration files to the on-board monitor 10. At a step 30, the locomotive on-board monitor calls home and provides an identification number for the event that precipitated the call-home, the road number of the calling locomotive, an authorization password (to gain access to the remote monitoring and diagnostic center 12) and its user name. The call is received at the monitoring and diagnostic center 14 at a step 32. At a step 34 the call is terminated. The remote monitoring and diagnostic center 14 calls the locomotive at a step 36. At a step 38 information collected by the on-board monitor 10, as described above and in the commonly-owned patent application entitled On-Board Monitor for a Railroad Locomotive referred to above, is downloaded to the remote monitoring and diagnostic center 14. At a decision step 40 the executing software at the remote monitoring and diagnostic center 14 determines whether there are any new configuration files to upload to the locomotive on-board monitor 10. In response to the decision step 40, new configuration files are uploaded at a step 42. Following up loading of the new configuration file, processing proceeds to a step 44 where the call is terminated. If there are no new configuration files to upload, processing moves directly from the decision step 38 to the step 44. At a step 46, the on-board monitor 10 reads the new configuration files and modifies its operations accordingly.

As discussed above, under normal conditions, the remote monitoring and diagnostic center 14 periodically initiates a call to the locomotive. Under these circumstances, the process of uploading new configuration files begins at the step 36 of FIG. 2.

Continuing with the heuristic example involving the operational log discussed above, the on-board monitor 10 calls home, identifying itself by a locomotive road number and provides an event number that represents the fault condition: operational log is full. Upon review of the operational log entries, a locomotive expert at the remote monitoring and diagnostic center 14 determines that the on-board monitor 10 is unable to communicate with one of the locomotive control systems. Each time the on-board monitor 10 attempts to read data from that control system, an entry is generated in the operational log stating that the data download was unsuccessful. This entry is generated each time the on-board monitor 10 attempts to download data from the errant control system. If these download attempts are made at a high frequency (for example, once a minute) the operational log will quickly fill to capacity. As discussed above, a full operational log is an event for which the on-board monitor 10 has been configured to immediately call home. Once the locomotive expert at the remote monitoring and diagnostic center 14 understands the nature of this problem and the reason why this particular on-board monitor 10 is calling home frequently, the expert can reconfigure the on-board monitor 10. This is accomplished by modifying the file to define the "operations log full" event as one that should not generate a call home. In accord with the present invention, this reconfiguration file information will be sent to the on-board monitor 10 as discussed herein. After reconfiguration, the onboard monitor 10 will continue to note in the operational log its inability to communicate with the control systems, but when the operational log reaches its capacity, a call-home will not be initiated. At the remote monitoring and diagnostic center 14, in response to this situation, the locomotive repair expert will arrange for repair of the locomotive to correct this problem when the locomotive next arrives at a repair facility. Alternatively, the expert may request that a repair technician collect additional information from the locomotive concerning this problem, so that a repair recommendation can later be formulated.

While the invention has been described with reference to a preferred embodiment, it will be understood by those skilled in the art that various changes may be made and equivalent elements may be substituted for elements thereof, without departing from the scope of the invention. In addition, modifications may be made to adapt a particular situation more material to the teachings of the invention without departing from the essential scope thereof. Therefore, it is intended that the invention not be limited to the particular embodiment disclosed as the best mode contemplated for carrying out this invention, but rather that the invention includes all embodiments falling within the scope of the appended claims.

What is claimed is:

1. For use with a railroad locomotive comprising a plurality of operational systems monitored by an on-board monitor for collecting operational information from the operational systems in functional dependence on configuration information supplied to the on-board monitor by a remote monitoring and diagnostic center, wherein the operational information is transmitted to and analyzed at the remote monitoring and diagnostic center for assessing the operational performance of the locomotive, a method for controlling the on-board monitor comprising the steps of:

establishing a communications link between the on-board monitor and the remote monitoring and diagnostic center;

transmitting the operational information from the on-board monitor to the remote monitoring and diagnostic center over the communications link;

modifying on-board monitor configuration information in data storage at the remote monitoring and diagnostic center in response to the operational performance of the locomotive;

storing the modified configuration information at the remote monitoring and diagnostic center;

at the remote monitoring and diagnostic center, determining whether there is modified configuration information for the on-board monitor; and in response to determining if there is modified configuration information transmitting the modified configuration information to the on-board monitor from the remote monitoring and diagnostic center, such that the on-board monitor thereafter collects operational information in functional dependence on the modified configuration information.

2. The method of claim 1 wherein the step of modifying occurs in response to changes in the operational characteristics of the locomotive.

3. The method of claim 1 wherein the on-board monitor collects environmental information and the modifying of the configuration information occurs in response to a change in the environment in which the locomotive is operating.

4. For use with a railroad locomotive comprising a plurality of operational systems monitored by an on-board monitor for collecting operational information from the operational systems in functional dependence on configuration information supplied to the on-board monitor by a remote monitoring and diagnostic center, wherein the operational information is analyzed at the remote monitoring and diagnostic center for assessing the operational performance of the locomotive, an apparatus for controlling the on-board monitor, comprising a configuration modifier for modifying the on-board monitor configuration information at the remote monitoring and diagnostic center in response to the operational performance of the locomotive;

a storage device for storing the modified configuration information;

a first transmitter for transmitting a unique identification signal and operational information from the on-board monitor to the remote monitoring and diagnostic center;

a first receiver for receiving the unique identification signal and the operational information at the remote monitoring and diagnostic center, a second receiver at the on-board monitor;

a second transmitter in communication with the storage device for transmitting modified configuration information from the remote monitoring and diagnostic center to said second receiver, and wherein said modified configuration information thereafter controls operation of the onboard monitor.

5. The apparatus of claim 4 wherein the configuration modifier is responsive to changes in the operational characteristics of the locomotive.

6. The apparatus of claim 4 wherein the on-board monitor collects environmental information and the configuration modifier is responsive to a change in the environment in which the locomotive is operating.

7. For use with a railroad locomotive comprising a plurality of operational systems monitored by an on-board monitor for collecting operational information from the operational systems in functional dependence on configuration information supplied to the onboard monitor by a remote monitoring and diagnostic center, where the operational information is transmitted to and analyzed at the remote monitoring and diagnostic center for assessing the operational performance of the locomotive, apparatus for controlling the on-board monitor comprising:

a configuration modifier for modifying the on-board monitor configuration information at the remote monitoring and diagnostic center in response to the operational performance of the locomotive;

a storage device for storing the modified configuration information;

a first transmitter for transmitting a unique identification sisal from the on-board monitor to the remote monitoring and diagnostic center;

a remote monitoring and diagnostic center receiver for receiving the unique identification signal at the remote monitoring and diagnostic center and for activating a remote monitoring and diagnostic center transmitter in response thereto, with the remote monitoring and diagnostic center transmitter being in communication with the storage device for transmitting modified configuration information;

said remote monitoring and diagnostic center transmitter for calling the on-board monitor by transmitting a call signal thereto, in response to the unique identification signal;

an on-board monitor receiver at the on-board monitor for receiving the call signal and for activating an on-board monitor transmitter in response thereto;

said on-board monitor transmitter for transmitting operational information to the remote monitoring and diagnostic center receiver, and following transmission of the operational information, said remote monitoring and diagnostic center transmitter transmitting modified configuration information to said on-board monitor receiver.

* * * * *